United States Patent [19]

Fujikawa et al.

[11] Patent Number: 4,589,379

[45] Date of Patent: May 20, 1986

[54] COOLING APPARATUS FOR WATER-COOLED ENGINES

[75] Inventors: Tetsuzo Fujikawa, Kobe; Shinichi Tamba, Kakogawa, both of Japan

[73] Assignee: Kawasaki Jukogyo Kabushiki Kaisha, Kobe, Japan

[21] Appl. No.: 663,207

[22] Filed: Oct. 22, 1984

[30] Foreign Application Priority Data

Oct. 24, 1983 [JP] Japan ..... 58-198788

[51] Int. Cl.[4] ..... F01P 11/10

[52] U.S. Cl. ..... 123/41.49; 123/41.57; 123/41.58; 55/385 B; 55/400

[58] Field of Search ..... 123/41.48, 41.49, 41.57, 123/41.58, 41.65, 41.66, 41.01, 41.04; 416/179, 182, 189; 56/12.8, 12.9, 13.1, 16.7, 17.1, 17.2; 55/328, 337, 385 B, 400

[56] References Cited

U.S. PATENT DOCUMENTS

| | | | |
|---|---|---|---|
| Re. 23,146 | 9/1949 | Packwood | 55/400 |
| 2,242,495 | 5/1941 | Wolf | 123/41.49 |
| 2,327,932 | 8/1943 | Scarratt et al. | 123/41.49 |
| 2,449,110 | 9/1948 | Eells | 123/41.49 |
| 3,183,899 | 5/1965 | Tuggle | 123/41.65 |

FOREIGN PATENT DOCUMENTS

| | | | |
|---|---|---|---|
| 2050265 | 10/1970 | Fed. Rep. of Germany | 123/41.57 |
| 2747973 | 5/1979 | Fed. Rep. of Germany | 123/41.65 |
| 904786 | 11/1945 | France | 123/41.57 |
| 1433596 | 4/1976 | United Kingdom | 55/385 B |

*Primary Examiner*—William A. Cuchlinski, Jr.
*Attorney, Agent, or Firm*—Marshall, O'Toole, Gerstein, Murray & Bicknell

[57] ABSTRACT

This disclosure relates to cooling apparatus for a water-cooled internal combustion engine. The apparatus comprises a centrifugal fan driven by the engine when running, said fan having an intake air port and a discharge air opening. A rotary screen is also driven by the engine, the screen being disposed over the intake air port of the fan and substantially preventing debris from entering the intake air port. The apparatus further includes a cooling radiator, and a spiral-shaped duct connecting the radiator with the fan discharge air opening. Further separating means is provided in the duct for removing debris from the air, the separating means being at an intermediate part or at an end part of the duct.

6 Claims, 4 Drawing Figures

COOLING APPARATUS FOR WATER-COOLED ENGINES

BACKGROUND OF THE INVENTION

The present invention relates to cooling apparatus for water-cooled engines, and more particularly to a cooling apparatus for water-cooled internal combustion engines especially suited for use in agricultural tractors and the like.

In recent years, there has been a movement from air-cooled engines to water-cooled engines in agricultural machines such as small tractors, "ride-on" mowers and the like. This has been true in view of the reduced noise level of water-cooled engines and stabilization of engine performance. In these circumstances it becomes important to prevent the radiator of a water-cooled engine from clogging because of its use in an environment where dried grass, straw, gratings, and seeds of grass are flying around. This is particularly important where the engine is mounted in a relatively low, small-sized working machine such as a mower or a garden tractor.

Such a tractor usually has a screen in front of the radiator, and the conventional approach taken in the prior art has been largely to use a finer dust-proof screen or to corrugate the screen itself. However, dried grass, dandelion seeds and the like which are small and lightweight will still pass through such a screen, some being caught by the core of the radiator and clogging it. Further, a fine mesh screen itself may be clogged and the cleaning of the screen has been very troublesome.

SUMMARY OF THE INVENTION

Accordingly, a cooling apparatus for a water-cooled engine according to the present invention comprises a plurality of debris-removing means designed with regard to the size and mass of the dust and other particles to prevent the clogging of the radiator and screen. Such an engine has a cooling air intake, and the apparatus comprises a rotary screen disposed in the intake, a centrifugal fan disposed downstream of the rotary screen for sucking in cooling air, and a spiral duct that leads from the fan to the radiator. Further, the duct includes a separating section for removing debris contained in the cooling air currents by utilizing the centrifugal force acting on the debris.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Figure 1:
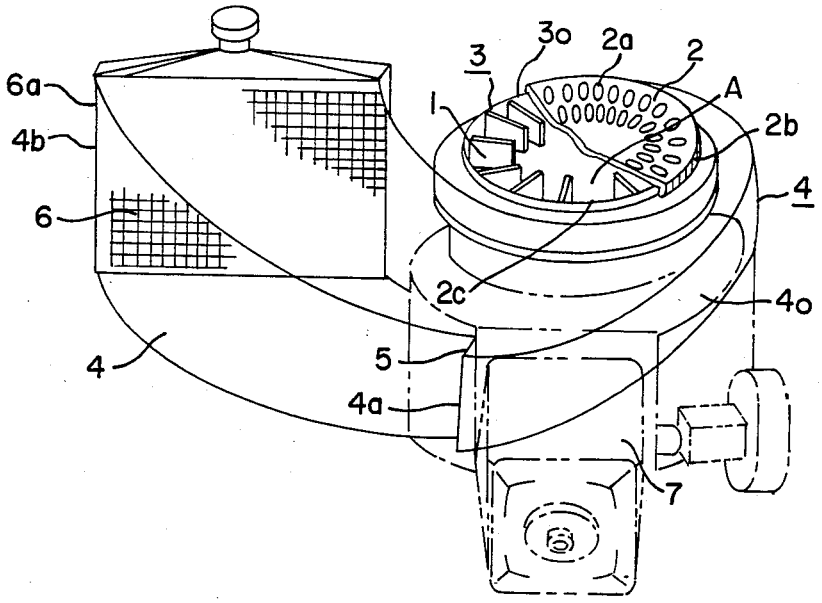
FIG. 1 is a perspective view showing cooling apparatus according to the present invention.

Briefly, a cooling apparatus for a water-cooled engine, according to a first feature of the invention, comprises a rotary screen 2 (FIG. 1) having a cutting function and installed in an engine cooling air intake port A, and a centrifugal fan 1 disposed downstream of the rotary screen 2 for producing an intake flow of cooling air, the arrangement being such that the cooling air flow produced by the centrifugal fan 1 is led to a radiator 6 through a spiral duct 4.

Thus, large size pieces of debris are repelled or cut up by the rotary screen 2 and thus prevented from entering the duct 4, while relatively small size pieces of debris which pass through the rotary screen 2 are given a centrifugal force. The small pieces move rapidly into the spiral duct 4, and there is a difference between the flow rates of the cooling air currents flowing along the outer and inner side wall within the spiral duct 4. The result is that the debris having a relatively large mass flows along the outer side wall surface of the spiral duct 4 by the action of centrifugal force, while the debris having a relatively small mass flows also along the outer side wall surface of the spiral duct due to the operation of the cyclone effect utilizing a revolving current. Further, debris of intermediate mass is subjected to a combination of centrifugal force and cyclone effect due to its flow speed and is thereby also caused to flow along the outer side wall surface of the spiral duct.

A second feature of the present invention is characterized in that, in addition to the foregoing structure, the outer side wall part at an intermediate portion or at the terminal end of the spiral duct 4 is provided with a separating section 5 for separating the debris contained in the cooling air flow by utilizing the centrifugal force and the like acting on the debris passing through the duct 4.

Thus, the debris flowing in the spiral duct 4 along the outer wall surface as a result of the rapid air flow according to said first feature of the invention, is separated by the separating section 5 disposed on the outer side wall in the intermediate portion or at the terminal end of the spiral duct 4, and the debris is discharged outside of the duct 4.

As a result, the radiator 6 receives cool air that is relatively free from debris, and since the rotary screen 2 and the fan are constantly rotated so long as the engine is running, the debris is constantly removed by its centrifugal force.

In FIG. 1, the numeral 1 denotes a centrifugal fan fastened to a conventional flywheel (not shown) mounted on the conventional crankshaft (also not shown) of the engine (in the embodiment of FIG. 1, the crankshaft is vertical); 2 denotes a generally horizontal disk-shaped rotary screen attached to the top of the centrifugal fan, the screen having openings 2*a* formed therein and cutting blades 2*b* formed around the peripheral edge of the lateral surface thereof; the peripheral edge of the screen being turned vertically downwardly and overlying an upwardly turned flange 2*c* on the engine housing; 3 denotes a centrifugal fan housing having a substantially spiral shape; 4 denotes a spiral duct that may be formed integrally with the spiral housing 3; 5 denotes a separating section formed in a portion of the spiral duct 4; 6 denotes a radiator for cooling the engine; and 7 denotes the engine generally.

As mentioned, the centrifugal fan 1 is attached to the crankshaft of the engine 1 and it rotates on the vertical axis of the crankshaft, and the rotary screen 2 is attached to the upper side of the centrifugal fan 1. The fan 1 has the air intake opening A at its center and it discharges the air outwardly to the housing 3. Further, the upper side of the centrifugal fan 1 is covered by the rotary screen 2 which is attached to the rotating blades of the fan, and the fan blades are surrounded with the fan housing 3 except for the suction opening A, at the center of the fan, and an outlet port of the fan housing communicates with the intake or inner end of the spiral duct 4, the latter perferably being formed as a continuous and integral part of the housing 3. Air enters the intake opening A through the screen 2 and flows through the openings 2*a* and past the peripheral edge of the screen. The cutting blades 2*b* are preferably circumferentially spaced, and the air flows through the spaces between the blades and through the annular space between the peripheral edge of the screen 2 and the adjacent surface of the stationary fan housing. The peripheral wall of the exhaust port 4*b* of the spiral duct 4 is connected to the peripheral wall 6*a* of the housing of the engine-cooling radiator 6. An intermediate portion of the outer wall 4*o* of the spiral duct 4 is formed with a narrow opening 4*a* along the height of the wall, thus defining the separating section 5 for separating debris in the air by utilizing the centrifugal force and the revolving flow acting on the debris. Further, the rotary screen 2 is attached so as to overlie the suction opening A of the fan with a slight clearance from the housing to allow for rotation thereof.

Thus, the present cooling apparatus constructed in the manner described above functions as follows in removing debris. When the engine 7 is started, the centrifugal fan 1 attached to the crankshaft of said engine 7 rotates and sucks air from outside the engine room into the housing 3 through the rotary screen 2 and into the suction opening A. In such operation, large pieces of debris are caught by the rotary screen 2 and are thrown outwardly in the tangential direction by its rotative force. Further, if long pieces of dried grass happen to be sucked toward the clearance between the outer edge of the rotary screen 2 and the suction opening A, they are cut up by the cutting blades 2*b* at the peripheral edge of the lateral surface of the rotary screen 2. Some of the cut pieces may be sucked into the fan intake together with air, while the remaining pieces are thrown away by the rotative force of the rotary screen 2, as described above. The air and any debris sucked in through the rotary screen 2 flows along the outer wall 3*o* of the fan housing 3 and into the spiral duct 4 under the action of the centrifugal fan 1. In such case, the cooling air flows in spiral form and follows the duct shape, and heavier debris which has substantial mass, e.g., dried grass cut by the rotary screen 2 and seeds of grains, for example, is subjected to a relatively large centrifugal force, so that it flows along the outer walls 3*o* and 4*o* of the fan housing 3 and the spiral duct 4. The lighter debris which has relatively small mass and which floats in the air, such as dust and dandelion seeds, are borne by a revolving air current flowing along the outer walls 3*o* and 4*o* of the fan housing and the spiral duct 4 and are gradually moved toward the outer walls 3*o* and 4*o*. Both the heavy and the light debris are finally discharged outside the spiral duct 4 through the opening 4*a* of the separating section 5 provided in the outer wall of the duct. Thus, the radiator 6 is cooled by cooling air substantially devoid of debris. Therefore, in the present invention, unlike the conventional cooling apparatus for water-cooled engines, there is substantially no possibility of the radiator 6 becoming clogged, and since the screen 2 rotates with the centrifugal fan 3, the debris screened out by the screen is thrown away from the screen by centrifugal force, thus substantially eliminating the possibility of clogging the screen.

Figure 4:
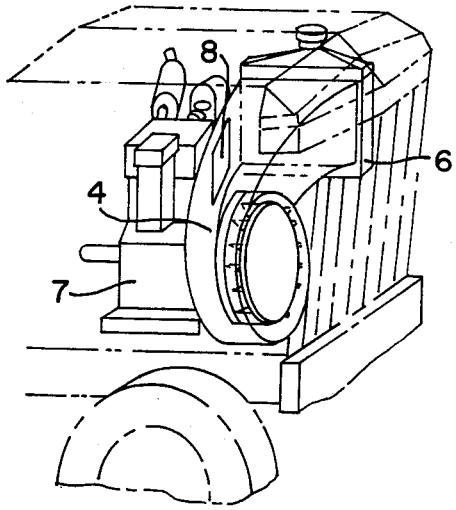
FIG. 4 is a fragmentary perspective view showing a cooling apparatus according to the invention mounted on an agricultural tractor.
Figure 3:
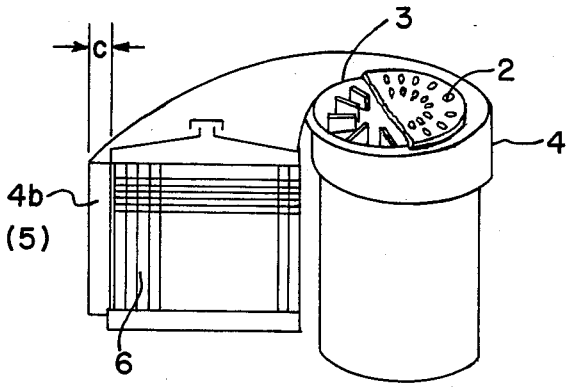
FIG. 3 is a perspective view showing an alternative embodiment of the invention.

While in the above embodiment, the separating section 5 for discharging the debris is provided in an intermediate portion of the spiral duct 4, it may instead be formed by providing a clearance C in the outer wall of the exhaust port 4*b* of the spiral duct, as shown in FIG. 3, where the duct 4 joins the housing of the radiator 6. Further, in the embodiment shown in FIG. 1, the centrifugal fan 1 is fixed to a vertical shaft on the crankshaft of the engine 7, but it may be fastened to a horizontal shaft of an engine having a horizontal crankshaft, as shown in FIG. 4.

Alternatively, it may be fixed on a rotating output shaft other than the crankshaft. Further, part of the cooling air in the spiral duct may be led to a location adjacent a side of the engine 7, particularly to a location adjacent to the carburetor and, by means of the opening 4*a* or an opening 8 (FIG. 4) formed in a lateral wall of the spiral duct 4, direct some of the air to effect ventilation of the engine.

Figure 2:
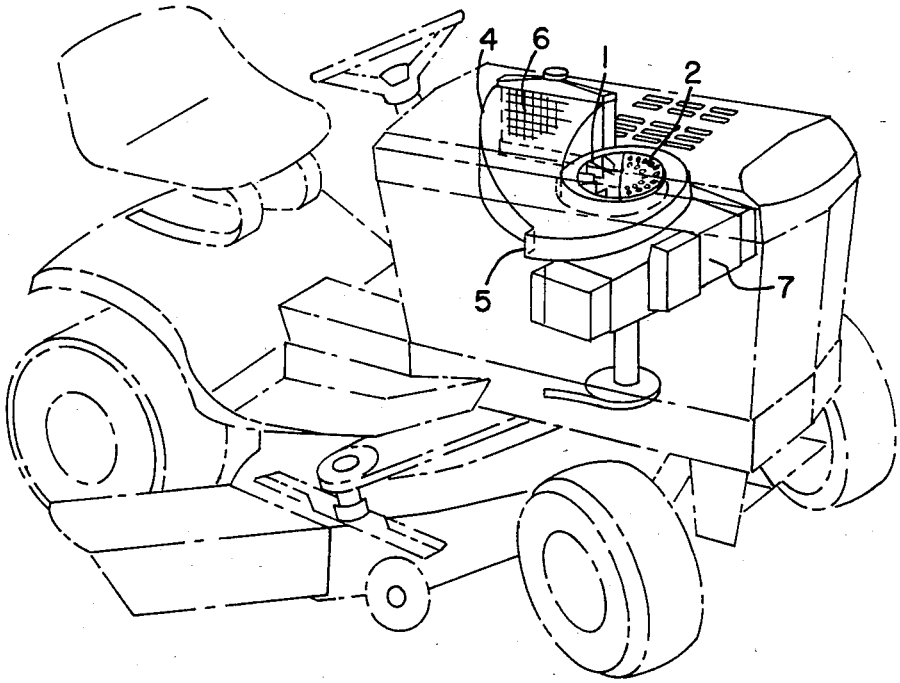
FIG. 2 is a perspective view showing the cooling apparatus mounted on a ride-on tractor.

With reference to FIG. 2, a vertical crankshaft engine may have the fan located below vent holes formed in the top side of the engine housing and the radiator mounted adjacent a grill formed in a vertical side wall of the housing. In the horizontal shaft engine shown in FIG. 4, the fan is located behind a grill in the front side of the housing.

As has been described so far, according to the present invention, with attention paid to differences in the size and mass of debris, a plurality of debris removing means suited to individual cases, i.e., the removing means according to the first feature of the invention and the removing means according to the second feature of the invention, are provided, whereby there is provided a cooling apparatus which is simple in construction and inexpensive and yet has a high efficiency. The present invention has the high derivative effect of promoting the change of engines used for small-sized agricultural machines to a water-cooled version which is technically superior.

The openings 4*a* and *c* shown in FIGS. 1 and 3 are formed in the outer wall of the spiral duct, which is the radially outer wall having the greater arc or length. In the arrangement of FIG. 1, the opening 4*c* is formed by offsetting the upstream and downstream portions of the outer wall, the upstream portion having a greater radial dimension than the downstream portion. In this manner, the debris follows closely along the upstream portion of the outer wall and flows out of the opening. The radial width of the opening 4*a* relative to the overall radial width of the duct immediately upstream from the opening, should be sufficient to remove the debris but not to lose an excessive amount of the cooling air. The radial width is also a factor of the flow rate of the air, the opening being narrower in the instance of faster air movement. In the arrangements shown, the opening width is approximately one-eighth to one-tenth the overall radial width of the duct.

What is claimed is:

1. Cooling apparatus for a water-cooled internal combustion engine including a shaft that rotates when the engine is running, said apparatus comprising a centrifugal fan adapted to be connected to and rotated by said shaft, said fan having an intake air port and a discharge air opening, a rotary screen adapted to be operatively connected to and rotated by said shaft, said screen being disposed in said intake air port, a cooling radiator, a spiral-shaped duct connecting said radiator with said discharge air opening, and separating means on said duct, said separating means comprising an opening formed in the outer wall of said duct.

2. Cooling apparatus for a water-cooled internal combustion engine including a shaft that rotates when the engine is running, said apparatus comprising a centrifugal fan adapted to be connected to and rotated by said shaft, said fan having an intake air port and a discharge air opening, and a rotary screen adapted to be operatively connected to and rotated by said shaft, said screen being disposed in said intake air port, said fan comprising a centrifugal fan member, a housing around said member, said housing having an opening therein forming said intake air port, said screen having a peripheral edge which extends closely adjacent said housing, and said screen having a plurality of blades formed along said peripheral edge.

3. Cooling apparatus as set forth in claim 2, wherein said screen is generally disk-shaped and has a plurality of air intake holes formed therein.

4. Cooling apparatus for a water-cooled engine, comprising a fan including an intake air port and a discharge port, a radiator, a spiral-shaped duct connecting said discharge part with said radiator, and debris separating means in said duct for removing debris from the air by utilizing the centrifugal force and the like acting on the debris passing through said duct, said duct including a spiral-shaped outer wall and said centrifugal force and the like causing the debris to move along said outer wall, and said separating means comprising an opening in said outer wall.

5. Cooling apparatus as set forth in claim 4, wherein said opening is intermediate said fan and said radiator.

6. Cooling apparatus as set forth in claim 4, wherein said opening is closely adjacent said radiator.

* * * * *